US006825761B2

(12) United States Patent
Christ et al.

(10) Patent No.: US 6,825,761 B2
(45) Date of Patent: Nov. 30, 2004

(54) SYSTEM FOR AUTOMATICALLY MONITORING PERSONS IN A DOMESTIC ENVIRONMENT

(75) Inventors: Tilo Christ, Erlangen (DE); Michael Mankopf, Möhrendorf (DE); Volker Schmidt, Erlangen (DE)

(73) Assignee: Siemens AG, Munich (DE)

( * ) Notice: Subject to any disclaimer, the term of this patent is extended or adjusted under 35 U.S.C. 154(b) by 13 days.

(21) Appl. No.: 10/260,515

(22) Filed: Oct. 1, 2002

(65) Prior Publication Data

US 2003/0098793 A1 May 29, 2003

(30) Foreign Application Priority Data

Oct. 1, 2001 (DE) ..... 101 48 444

(51) Int. Cl.[7] ..... G08B 29/00
(52) U.S. Cl. ..... 340/506; 340/573.1
(58) Field of Search ..... 340/506, 573.1, 340/573.4, 825.19, 870.02, 5.1, 3.1, 825.36

(56) References Cited

U.S. PATENT DOCUMENTS 5,396,227 A * 3/1995 Carroll et al. ..... 340/825.36
5,692,215 A * 11/1997 Kutzik et al. ..... 710/18
5,706,191 A * 1/1998 Bassett et al. ..... 700/9
6,002,994 A 12/1999 Lane et al. ..... 702/188
6,054,928 A 4/2000 Lemelson et al. ..... 340/573.4
6,108,685 A * 8/2000 Kutzik et al. ..... 709/200
6,313,743 B1 11/2001 Abraham-Fuchs et al. .. 340/505
6,525,658 B2 * 2/2003 Streetman et al. ..... 340/522

FOREIGN PATENT DOCUMENTS

| | | |
|---|---|---|
| DE | 196 27 996 | 1/1998 |
| EP | 1 071 055 A1 | 1/2001 |
| GB | 2 306 275 | 4/1997 |
| GB | 2 343 040 A | 4/2000 |
| JP | 2000090366 A | 3/2000 |
| WO | 94/20939 | 9/1994 |
| WO | 99/06979 | 2/1999 |

* cited by examiner

*Primary Examiner*—Toan N. Pham
(74) *Attorney, Agent, or Firm*—Young & Thompson

(57) ABSTRACT

A system for automatically monitoring persons in a domestic environment by using sensors for detecting characteristic parameters which are supplied to a surveillance center which, if necessary, alerts an alarm center, particularly a service provider, the sensors detecting a plurality of domestic devices (including measuring devices) used or operated regularly and the sensor data being supplied personalized and automatically to the center which evaluates the incoming data by using an expert system with predetermined rules.

20 Claims, 1 Drawing Sheet

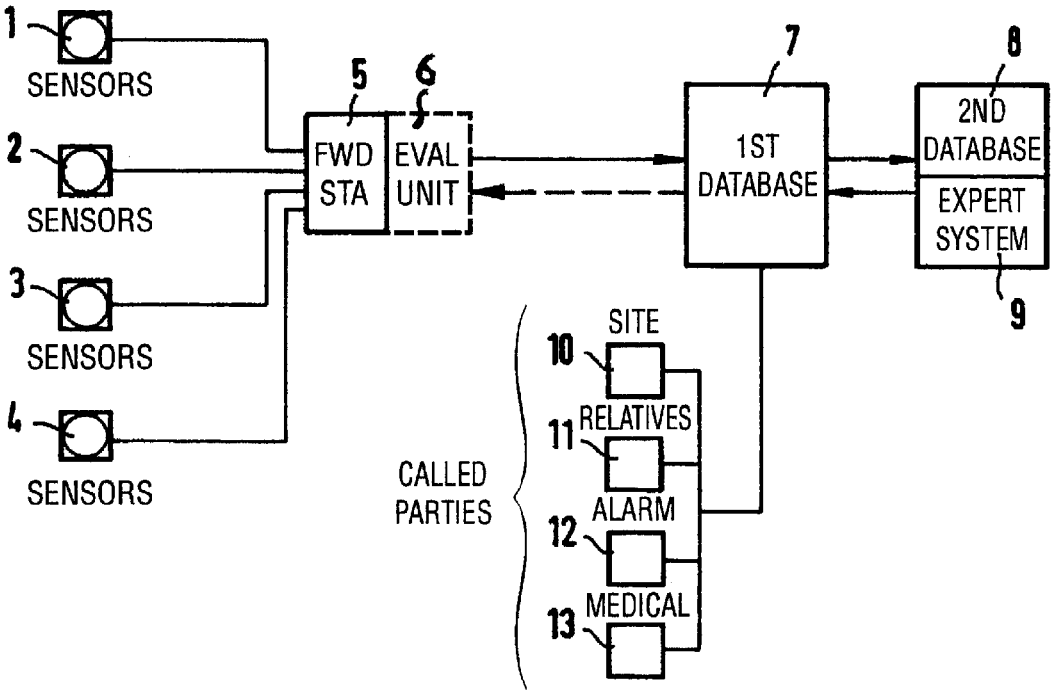
1
SENSORS
2
SENSORS
3
SENSORS
4
SENSORS
5
FWD STA
6
EVAL UNIT
7
1ST DATABASE
8
2ND DATABASE
EXPERT SYSTEM
9
CALLED PARTIES
10
SITE
11
RELATIVES
12
ALARM
13
MEDICAL

SYSTEM FOR AUTOMATICALLY MONITORING PERSONS IN A DOMESTIC ENVIRONMENT

FIELD OF THE INVENTION

The invention relates to a system for automatically monitoring persons and their consumption/use of domestic devices in a domestic environment by using sensors for detecting characteristic parameters which are supplied to a surveillance center which, if necessary, alerts an alarm center, particularly a service provider.

BACKGROUND OF THE INVENTION

Such systems for special surveillance situations have already been proposed several times. Thus, for example, WO 94/20939 describes a system in which a motion detector is coupled with a time-controlled alarm switch which blanks out typical rest periods in order to trigger an alarm when a motion signal does not occur within a preplanned period of time and may indicate a possible stopping of motion or unconsciousness of the monitored person.

From Offenlegunsschrift DE 196 27 996 A1, an acoustic space surveillance system has become known in which a loudness level which has been exceeded for longer than an adjustable period of time triggers the alarm signal. In practice, however, such a device is only suitable for monitoring small children (baby phone).

WO 99/06979 describes a device in which microphones or location or motion detectors are provided. It is either possible to trigger an alarm by inputting special code words via the microphone, which, however, is completely unsuitable for many cases of surveillance, or a location and motion detector followed by an analysis program determines whether a person covered has not moved for a particular period of time.

GB 2 306 275 A, finally, indicates an acoustic baby phone, or one which analyzes temperature signals, which, however, is not suitable for monitoring persons in their domestic environment with regard to whether they behave in a "normal" way, because of its specific orientation toward monitoring small children.

SUMMARY OF THE INVENTION

The invention is, therefore, based on the object of developing a system for automatically monitoring persons, e.g., activity of a person as expressed by device use and consumption by used devices, in a domestic environment of the type initially mentioned, in such a manner that it is capable of detecting behavior of these persons which is appropriate to everyday conditions, without great effort and without expensive installations, without these persons having to collaborate in any way and without it being a matter of only detecting extreme situations such as unconsciousness or the like.

To achieve this object, it is provided in accordance with the invention that the sensors detect a plurality of domestic devices used or operated regularly and that the sensor data are supplied personalized and automatically to the center which evaluates the incoming data by using an expert system with predetermined rules. In this way, use as expressed either by consumption quantity or frequency, or both, can be easily monitored and action taken.

In contrast to the very limited acoustic detection devices or elaborate position and motion detectors which, incidentally, can only ever detect quite particular individual points and cannot provide a genuine analysis of the behavior of a person, the sensors according to the invention primarily detect normal domestic devices such as, for example, the opening and closing of the refrigerator door or the switching-on and -off of the stove, of the dishwasher, of the coffee machine, of the television set or of the toilet flush. In addition, the switching-on of light switches can be monitored with room-related resolution, the opening and closing of doors, blinds or the use of the telephone can be monitored via the device sensors to be used according to the invention. If these devices are not operated or are operated extremely frequently within a particular period of time, these deviations provide a good impression of whether the person monitored is behaving in a "normal" way, especially when evaluated via an expert system and especially with the evaluation of a plurality of such device data—naturally, the mere nonoperation of an individual light switch or of a blind by itself provides only little information. The devices which are monitored with the aid of the single sensors according to the invention can also include measuring devices, for example water consumption, current consumption or gas consumption, and these values can also be called up by the system directly as a service of the corresponding municipal utilities. Finally, examples of domestic devices which are used or operated more frequently are also intended to include the bed, the couch or an easy chair and corresponding mattress sensors detect when the person monitored is sitting down or lying down, is getting up again and how he or she is moving.

From the combination of the data obtained during this process, in particular, it is possible to detect quite well, fully automatically and without further assistance, particularly without assistance of the person monitored him/herself, via an expert system whether the person is conducting a life which is normal in all points or whether there are characteristic deviations in a particular direction which may require intervention. If, for example, all parameters monitored correspond to the norm but the refrigerator door is no longer opened and the stove is no longer switched on, this will not cause the emergency doctor to be called for because it is detected that the person is still moving normally in the apartment as before. However, it appears that he/she exhibits attacks or a sickness for whatever reasons, so that he/she is no longer eating or drinking and this, naturally, is sufficient reason either for making a control call and speaking to the person or sending a carer to check up.

It is possible, but also very expensive, to design the system in such a manner that each sensor message is automatically forwarded to the center. It is simpler if the sensors and/or the domestic forwarding station at which the signals of all sensors of the apartment are connected compare the sensor data, particularly the frequency of operation of a device, with predetermined data and forward them to the center only in the case of deviations.

In the data analysis of the sensor data, a fixed value can be predetermined by the user in the simplest case. For example, opening the refrigerator less than once per day can automatically lead to the triggering of an alarm.

However, it is particularly advantageous if a learning system is used as expert system, which learns the behavior of the person monitored and only triggers alarms in the case of deviations. Such methods are in existence, for example, for detecting the misuse of mobile telephones or credit cards.

In addition, the system can generate alarms of greatly differing urgency, for example in dependence on the probability with which a critical state exists. When there are no signals from all monitored devices over a particular period of time—including, for example, the lack of devices of the mattress sensor at night—a critical case would appear to exist with high probability whereas the mere fact that the stove has not been switched on whilst all other sensor messages are normal certainly indicates a disturbance in the behavior and well-being of the person monitored which, at the most, is uncritical. These alarms of differing urgency can be forwarded to any position via fax, email, SMS or the like and can extend from a control call, the informing of a domestic care service up to the immediate alerting of an emergency medical center.

To ensure confidentiality, it can be provided in development of the invention that the center is distributed split to two service providers, one of which forwards the incoming data with encrypted personal data to the actual service provider handling the data and also handles the connection to the alarm center.

This can be implemented in a particularly simple manner if two separate databases are provided right from the start, namely a user database with person-related data of the person monitored, contact addresses, care services, pseudonyms or the like which is then resident at a service provider, and a sensor database for evaluating the incoming sensor data. The first service provider administering the user database generates the pseudonym and forwards its availability and the pseudonym to the second service provider who then carries out the actual monitoring but does not know the identity of the person concerned. In the case of an alarm, the second service provider sends a message with the pseudonym to the first service provider. The latter determines the associated person and starts an adequate response, such as, for example, informing relatives, care services or the like without himself having access to the data of the person concerned.

The advantage of the system according to the invention consists in, on the one hand, that no active collaboration of the person concerned is required at all. In addition, the system has the advantage that absolute confidentiality can be preserved. Monitoring the plurality of domestic devices lowers the rate of false alarms because, for example, a person concerned has forgotten to call, and, finally, the system according to the invention provides a very inexpensive utilization of existing infrastructures.

BRIEF DESCRIPTION OF THE DRAWINGS

Further advantages, features and details of the invention can be obtained from the following description of an exemplary embodiment and by means of the drawing which diagrammatically shows a sequence diagram of a system according to the invention.

DETAILED DESCRIPTION OF THE INVENTION

1 to 4 designate different actuation sensors which, for example, indicate the actuation or the use of a particular device in the household of the person monitored, such as, for example, a mattress sensor, a sensor which monitors the opening of the refrigerator door or the switching-on of the stove, of the toilet flush or of the television set. These sensor signals are preferably not forwarded directly to a center but to a domestic forwarding station 5 which, if necessary, can be coupled to an evaluating unit 6 so that it initiates not only a collective forwarding but also preliminary screening and pre-assessment of the sensor data before they are forwarded to the center. In the exemplary embodiment shown, the center is distributed to two different service providers and comprises a user database 7, resident at the first service provider, with person-related data of the person monitored, contact addresses, care services, pseudonyms or the like. From there, the data provided with the corresponding pseudonym are forwarded to the sensor database 8 at the second service provider, this sensor database being coupled to an expert system 9 in order to evaluate the incoming sensor data. The result of the evaluation is reported by the sensor database 8 back to the user database 7 which, in turn, because it is the only one that knows which patient is hidden behind the data evaluated anonymously, can trigger different alarms, for example it can start an inquiry from the person monitored (call back station 10) or call relatives (forwarding station 11), it can also deliver an alarm message at a care service 12 or, if necessary, inform the emergency medical center 13 directly. Naturally, a whole series of other different alarm stages are also possible and, instead of the four device sensors shown, a multiplicity of other sensors can be included in the system. These can also include sensors about the consumption data in the respective household such as water consumption, electricity consumption or gas consumption.

In principle, there are a number of different possibilities with regard to the design of the sensors and their further interconnection. Assuming a typical case, namely a sensor which signals the switching-on of the stove, the simplest possibility is that the sensor signals to the center every time when it is switched on. The center then decides what is to be done.

Instead of this direct signalling, the stove sensor can deliver a message to the local forwarding station every time when it is switched on. This local forwarding station handles the signal transmission for all sensors in the household. It is only the forwarding station which needs to be able to handle remote communication and all other devices can be connected to the forwarding station via a local radio link (e.g. DECT). In this case, in principle, the sensor data can be forwarded from the local forwarding station, as has already been described above, or the data can first be checked and evaluated in the forwarding station so that forwarding occurs only when the local forwarding station, with its limited possibilities of testing, believes that it has detected an emergency.

Finally, it would also be possible that the sensor knows, for example through the stove electronics themselves, how often it needs to be or should be switched on. It then reports to the center when it has not been switched on often enough. Although this lowers the communication costs, it is, on the other hand, expensive because of the correspondingly more expensive sensor electronics.

What is claimed is:

1. A system for automatically monitoring consumption activity of a person in a domestic environment, the system comprising:

plural sensors for detecting consumption activity of plural domestic devices that are in a domestic environment of a person being monitored and for automatically sending signals that identify consumption activity of the person being monitored and the detected activity, said plural sensors sensing activity of a plurality of water, gas, and electric devices through the use of water meters, gas meters, and ammeters;

a surveillance center that receives said signals from said plural sensors;

an expert system at said surveillance center for automatically evaluating the detected consumption activity based on predetermined rules, the expert system initiating alarm output based on the automatic evaluation; and an alarm center for generating an alarm signal in response to the alarm output from said surveillance center.

2. The system of claim 1, wherein, the detected consumption activity relates to a frequency of use of a monitored device, and said expert system compares a detected frequency of use of at least one of the domestic devices to a predetermined frequency and generates an output when the detected frequency deviates from the predetermined frequency.

3. The system of claim 1, wherein said expert system learns a normal consumption activity of the plural domestic devices and generates an output when the detected activity deviates from the learned normal activity.

4. The system of claim 1, wherein said expert system evaluates the detected use activity of a plurality of the domestic devices and generates an output only when more than one of the detected activities deviates from the predetermined rules concerning frequency of use.

5. The system of claim 1, wherein said expert system analyzes utilization of the domestic devices and revises the predetermined rules based on the analysis.

6. The system of claim 1, wherein said plural sensors include a telephone usage sensor.

7. The system of claim 1, wherein said surveillance center further comprises a first service provider that receives the output from said sensors, appends personal data identifying the person whose activity is being monitored to form encrypted data, and sends the encrypted data to a second service provider that receives the encrypted data, the second service provider hosting the surveillance center and the expert system.

8. The system of claim 7, wherein the first service provider comprises a first database that includes the personal data and contact information for entities, including contact addresses and nursing services, that are to receive the alarm output from said surveillance center and a second sensor database for storing incoming sensor data derived from the sensor signals, the alarm output being routed from the second service provider via the first service provider to the entities, one of which entities hosts the alarm center.

9. The system of claim 1, wherein said alarm center generates alarms with different levels of urgency, depending on the output from said surveillance center.

10. The system of claim 1, wherein said surveillance center is at least one municipal utility that accepts the sensor signals from the plural sensors and stores the received sensor signals as consumption data within a database located at the municipal utility.

11. The system of claim 10, wherein one municipal utility accepting sensor signals is a telephone company, the telephone company storing telephone usage data indicating an historic telephone use frequency for the person, and a current telephone use frequency for the person sufficient to determine if the current telephone frequency use deviates beyond a predetermined rule within the expert system so as to trigger a non-standard use frequency alarm.

12. The system of claim 1, further comprising:

a first service provider that accepts the sensor signals from the plural sensors and attaches, to the sensor signals, encrypted personal data identifying the person whose activity is being monitored, the sensor signals together with the attached encrypted personal data being sent by the first service provider to the surveillance center hosting the expert system, the signal generated by the surveillance center being routed via the first service provided to trigger an alarm at the alarm center.

13. A method for automatically monitoring consumption activity of a person in a domestic environment, the method comprising the steps of:

detecting consumption, including both quantity and frequency of use, activity of plural domestic devices that are in a domestic environment of a person being monitored using plural sensors;

automatically sending signals from the sensors that identify the person being monitored and the detected activity;

receiving the signals from the sensors at a surveillance center;

automatically evaluating the detected consumption activity based on predetermined rules using an expert system at the surveillance center; and generating a signal in response to an output from the surveillance center when usage of any of water meters, gas meters, and ammeters deviates from a normal usage.

14. The method of claim 13, wherein the expert system performs the steps of comparing a detected consumption frequency of operation of at least one of the domestic devices to a predetermined frequency and generates an output when the detected frequency deviates from the predetermined frequency.

15. The method of claim 13, wherein the expert system performs the steps of learning a normal usage of the plural domestic devices and generating an output when the detected activity deviates from the learned normal usage.

16. The method of claim 13, the expert system performs the steps of evaluating the detected activity of a plurality of the domestic devices and generating an output only when more than one of the detected activities deviates from the predetermined rules.

17. The method of claim 13, wherein the expert system performs the steps of analyzing frequency and quantity utilization of the domestic devices and revises the predetermined rules based on the analysis.

18. The method of claim 10, wherein said plural sensors include a sensor for sensing activity indicating use frequency of a telephone.

19. The method of claim 13, wherein the surveillance center performs the steps of encrypting the output from the sensors and sending the encrypted data to a separate service provider.

20. A system for automatically monitoring activity of a person in a domestic environment as measured by domestic device usage, the system comprising:

plural sensors for detecting utility consumption activity of plural gas, electric, and water devices that are in a domestic environment of a person being monitored and for automatically sending signals that identify the detected utility consumption activity of the plural gas, electric, and water devices as to consumed quantities of corresponding gas, electric, and water utilities;

a surveillance center that receives said signals from said plural sensors and encrypts consumption data in said signals;

an expert system that receives the encrypted data and automatically learns a normal consumption activity of the plural gas, electric, and water devices and, after having learned the normal consumption activity monitors a current level of consumption activity while comparing the current level of consumption activity against the learned normal consumption activity; and said surveillance center generating a signal in response to an output from said expert system when the comparison of the current level of consumption activity against the learned normal consumption activity triggers a monitoring rule within the expert system.

* * * * *